United States Patent [19]

Audic

[11] 4,269,469

[45] May 26, 1981

[54] CONTACT TERMINAL CONNECTOR

[75] Inventor: Bernard Audic, Clamart, France

[73] Assignee: Souriau & Cie, Boulogne-Billancourt, France

[21] Appl. No.: 29,647

[22] Filed: Apr. 13, 1979

[30] Foreign Application Priority Data

Apr. 21, 1978 [FR] France ..... 78 11820
Mar. 12, 1979 [FR] France ..... 79 06274

[51] Int. Cl.[3] ..... H01R 17/06
[52] U.S. Cl. ..... 339/177 R
[58] Field of Search ..... 339/177 R, 177 E, 97 R, 339/97 P, 276 R, 276 T

[56] References Cited

U.S. PATENT DOCUMENTS

| | | | |
|---|---|---|---|
| 2,536,003 | 12/1950 | Dupre | 339/177 E |
| 3,539,976 | 11/1970 | Reynolds | 339/177 E |
| 3,660,805 | 5/1972 | McDonough | 339/177 R |
| 3,670,293 | 6/1972 | Garver | 339/276 T |
| 3,959,868 | 6/1976 | Mathe | 339/97 P |

*Primary Examiner*—Neil Abrams

*Attorney, Agent, or Firm*—J. Harold Nissen

[57] ABSTRACT

A contact terminal for terminating a coaxial cable has a first conductor member with a U-shaped connection portion to receive the conductor core of the coaxial cable; and a second conductor member, electrically insulated from the first conductor member, also having a U-shaped connection portion to receive the conductor tube or screen of the coaxial cable. The second conductor member has a wider base portion than the base portion of the first conductor member. Both U-shaped connector portions are disposed in a line and opened in the same direction to permit the connection to be made merely by laying a partially stripped end of the coaxial cable into the opened connections and folding the opened legs of the first conductor member around the conductor core of the coaxial cable and the opened legs of the second conductor member around the conductor screen of the coaxial cable. The contact terminal may also include an additional clamp which clamps around the core insulating layer to provide further mechanical support.

13 Claims, 17 Drawing Figures

CONTACT TERMINAL CONNECTOR

BACKGROUND OF THE INVENTION

The invention relates to electric contact terminals, designed to insure linkage with coaxial cables which are to be connected to one another, or to equipment, by means of connectors, and its object is, more particularly, such contact terminals for which the operation of connection can be carried out automatically.

At present, the connection of a coaxial cable to a connector is obtained by first connecting the core of the cable, previously stripped, to a first conductor element, for example by a first operation of crimping, then connecting, for example by a second crimping operation, the armor braid, likewise stripped beforehand, to another conductor element, which can be similar and adjacent or near to the first in the connector equipped with these elements, or which can envelope the first in its position in the connector, the first and second conductor elements then being, respectively, the central conductor element and the peripheral conductor element of a coaxial type connection terminal for a coaxial cable, one end of which, suitably bared, is introduced parallel to the axis of the cable, in the coaxial terminal prior to the crimping operations.

It is the object of the invention to permit automation of the operations of connection of a coaxial cable, which at the present time are carried out manually, by proposing conductive contact elements which can be combined to embody two types of terminals, one of which is particularly intended for the coaxial connection of the coaxial cable, and the other is intended particularly for the connection of the core and the armor braid of the coaxial cable to nearby or adjacent conductor elements, combined with an adaptor proper to the invention.

With this in mind, the contact terminal according to the invention, comprising two conductor elements electrically insulated from one another, and each having a connection portion, by means of which the first and the second elements are connected, respectively, to the core and to the armor braid of a coaxial cable, is characterized in that each of these connecting portions is constituted in the form of a portion with a U-shaped section, that of the second element having a wider base than that of the first, and being disposed in the extension of the latter, in the position of use of the terminal, the two U-shaped portions being open on the same side, so that the positioning of the coaxial cable on the contact terminal, with a view to carrying out the operations of connection, may be done not only by a displacement of the coaxial cable parallel to its axis, but also by a displacement in a translation perpendicular to its axis, which is easy to embody automatically, the connection properly speaking of the core and the armor braid of the cable, respectively in the U-shaped portion of the first and of the second element, being obtainable by crimping, by welding, or by any other form of connection, compatible with a displacement in a translation perpendicular to the axis of the coaxial cable. In particular, at least one of the U-shaped portions of the terminal can be equipped with an internal contact fork, between the two arms of which the core and/or the armor braid of the cable, according to cases, will be inserted and retained following a positioning by translation perpendicular to the axis. This internal fork of contact, constituted by an inserted piece or by a cutout in the flanks of the U-shaped portion, of arms folded back opposite one another, in the interior of this U-shaped portion, can be of the elastic or semi-elastic type, the retention of the core an/or of the armor braid being insured by the elastic nip of the arms. But, advantageously, at least one of the internal contact forks is self-stripping, so that it will not be necessary to strip the end of the cable to free the core or the armor braid prior to the operation of positioning the cable on the terminal, with a view to a connection.

BRIEF DESCRIPTION OF THE DISCLOSURE

In a preferred form of embodiment, the terminal comprises a third U-shaped portion, disposed between the other two, in their extension, and open on the same side, the base of which is not as wide as that of the U-shaped portion of the second element, and wider than or equal to that of the U-shaped portion of the first element, in order to permit the mechanical attachment of the terminal on the insulating sheath of the core of the coaxial cable, so that by folding back the flanks of the U-shaped portions, it is possible to connect a coaxial cable by crimping its core, the insulating sheath of the core and the armor braid, respectively, in the U-shaped portion of the first element, in the third U-shaped portion and in the U-shaped portion of the second element, whether or not a fork is disposed in one of the U-shaped portions of the terminal.

A contact terminal of the first type according to the invention comprises a central element surrounded by a peripheral element, the central element being embodied by the first element, whose U-shaped portion prolongs one end of a body whose other end constitutes a contact head, and the peripheral element being embodied by the second element, the U-shaped portion of which is attached by an intermediate portion to a tubular body, which envelopes an insulating sleeve, itself surrounding the body of the central element, and being prolonged by an insulating tongue lodged between the U-shaped portion of the central element and the intermediate portion of the peripheral element. On one terminal of this first type, the third U-shaped portion is either borne by the central element, behind the U-shaped portion with the narrowest base, relative to the body of this central element, the insulating tongue being prolonged between the third U-shaped portion and the intermediate portion, or borne by the peripheral element, between the U-shaped position with the widest base and the intermediate portion.

In a preferred form of embodiment, the intermediate portion, having two lateral flanks capable of being folded back, also has a U-shaped section, so that after the connection of the coaxial cable, the folding back of the flanks around the portion or portions of the central element connected to the cable will insure the protection of this portion or portions. The height of the lateral flanks of the intermediate portion can be such that they may be folded back against one another by prolonging the tubular form of the body of the peripheral element and defining a pocket of air serving as a dielectric around the part not surrounded by the insulating tongue of the portion or portions of the central element connected to the cable.

If the connection of the coaxial cable is not to be coaxial itself, a contact terminal of the second type according to the invention will be used, for which the second element is constituted in the form of an adaptor equipped with a tip borne at one end of a curved rod, the other end of which bears the U-shaped portion with the widest base, the length of the rod being such that in position of use of the terminal, the tip is positioned in at least one U-shaped portion of a third conductor element adjacent to the first and electrically insulated from the latter, in such a way that it will be possible, in a single operation, to connect the core and the armor braid of the coaxial cable, respectively in the U-shaped portion of the first element and in the U-shaped portion of the adpator, the tip of which will have been previously connected in the U-shaped portion of the third conductor element in which the tip will have been positioned. In this type of terminal likewise, the third U-shaped portion can be borne, either by the first element or by the adaptor and the insulating sheath of the core of the coaxial cable can be mechanically linked to the terminal, for example by folding back the flanks of the third U-shaped portion, which is done at the same time as the folding back of the flanks of the U-shaped portions of the first and second elements on the core and on the armor braid if the connection is obtained by crimping.

And finally any contact terminal according to the invention, of the first or second type, is linked to other adjacent, identical terminals by a carrying strip, with a predetermined pitch, to constitute a continuous strip making it easily possible to automatically produce the connection by crimping of a coaxial cable on each of the terminals, the carrying strip being sheared during the connection.

The present invention will be better understood with the aid of special examples of embodiment which will be described below, by way of non-limiting example, with reference to the attached figures in which:

BRIEF DESCRIPTION OF THE DRAWINGS

And finally.

DESCRIPTION OF THE PREFERRED EMBODIMENT

Figure 1:
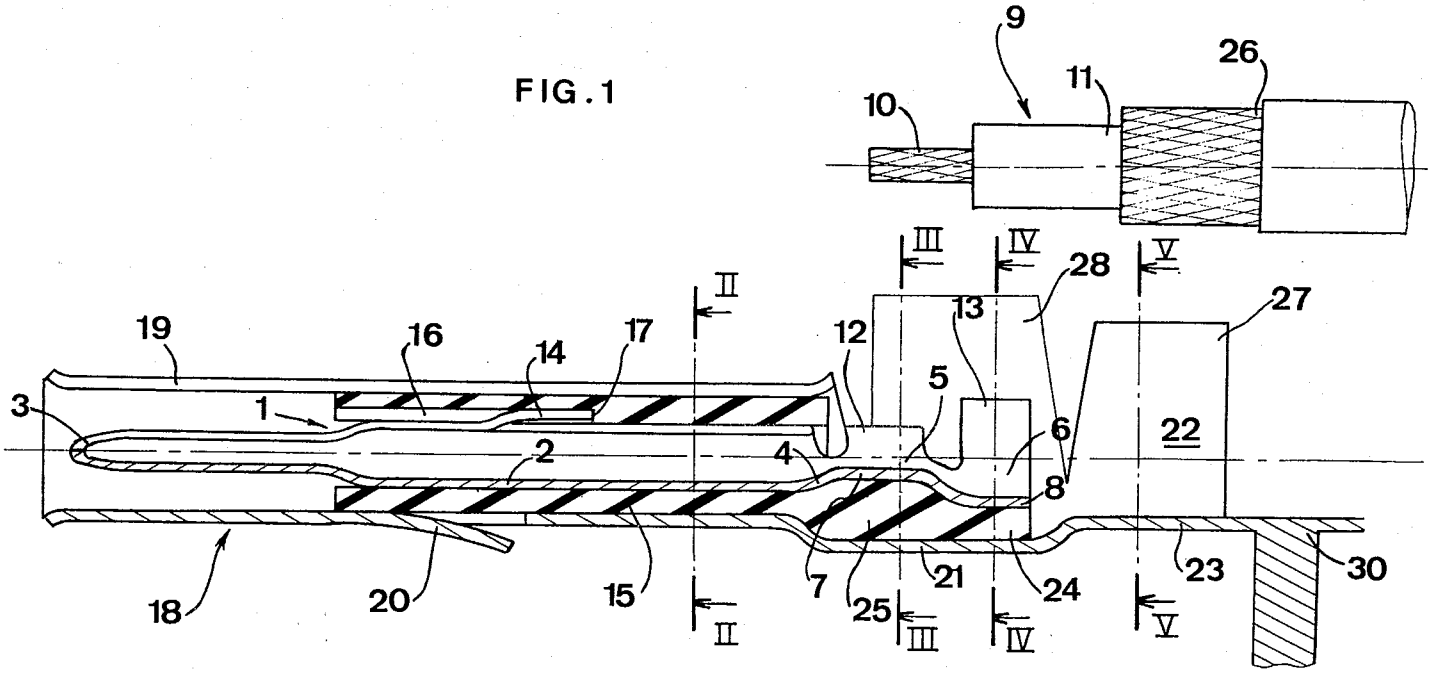
FIG. 1 represents, in axial section, a contact terminal of the first type, and the end to be connected, of a coaxial cable.
Figure 2:
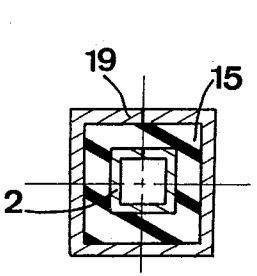
FIGS. 2 to 5 represent views in section, respectively along II—II, III—III, IV—IV and V—V of the terminal according to FIG. 1, before the operation of connection.

Referring to FIGS. 1 to 5 and 8 to 11, a first embodiment of the contact terminal is shown and comprises a central conductor element 1, constituted by a tubular body 2 of substantially square section, which is prolonged, at one end, by a contact head 3, designed to come in contact with a conductor element of complementary form (not shown), which is borne, for example, by the base of an electric connector on which it will be possible to mount a plug equipped with the contact terminal, the body 2 being prolonged, at its other end, by a tail 4 constituted by two portions 5 and 6, of U-shaped section. The base 8 of portion 6, situated furthest toward the end of central element 1, is wider than the base 7 of portion 5, which is shaped in an internal, radial swelling, so that core 10 and the insulating sheath 11, surrounding the core 10, of a coaxial cable 9, suitably stripped, may be received, respectively, in the U-shaped portion 5 and in U-shaped portion 6 of the central element 1 without causing any deformation of the stripped end of the cable 9. By folding back the flanks 12 of the U-shaped portion 5, and the flanks 13 of the U-shaped portion 6, respectively on the core 10 and on the insulating sheath 11, the connection of the latter on the central conductor element 1 will be insured by crimping, the electric contact being established between core 10 and portion 5.

By cutting and folding outward a part of the tubular body 2, an elastic retention tab 14 is embodied, which presses against an internal shoulder 17, defined by the end of a groove 16 formed in the interior of a sleeve 15 of insulating material, of substantially square section, in which the central element 1 is lodged, so that any withdrawal of this central element 1 in sleeve 15, under the influence of axial forces developing on the contact head 3, during a connection with the conductor element of complementary form, is prevented by retention tab 14.

Figure 3:
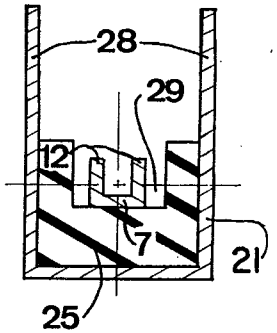
Figure 4:
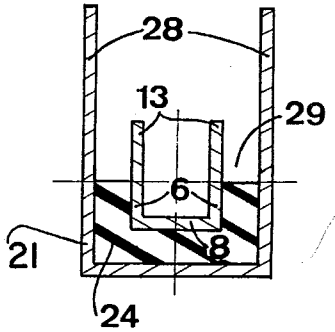
Figure 5:
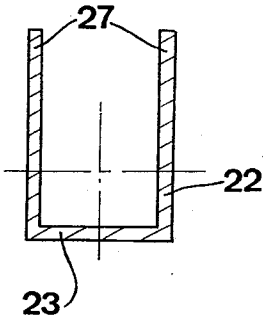
Figure 6:
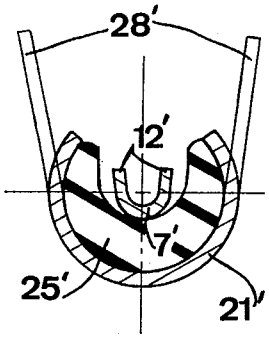
FIGS. 6 and 7 represent, likewise before the operation of connection, views analogous to those of FIGS. 3 and 4, for a variation of embodiment with circular section, of the terminal of the first type, with a section in the form of a quadrilateral, represented in FIG. 1.
Figure 7:
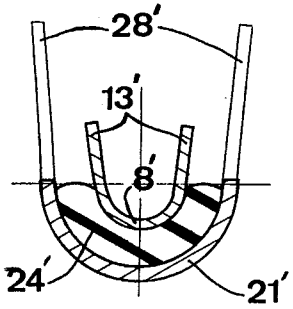
Figure 11:
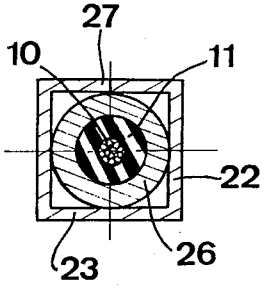
FIGS. 8 to 11 correspond to FIGS. 2 to 5, but after the operation of connection.
Figure 10:
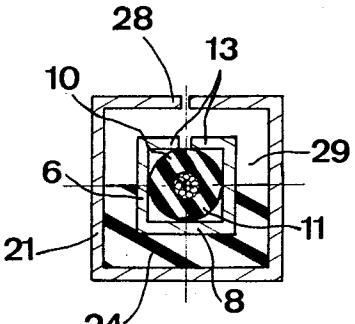
Figure 13:
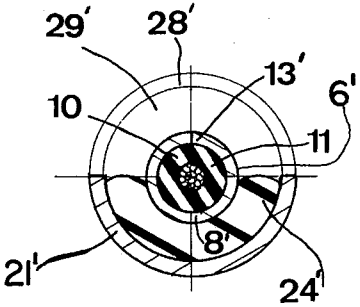
FIGS. 12 and 13 correspond to FIGS. 6 and 7, but after the operation of connection.
Figure 9:
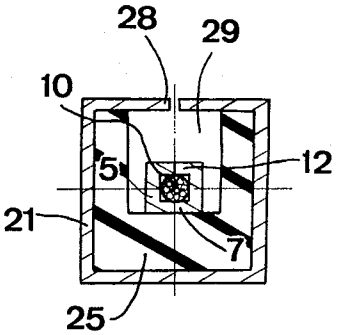
Figure 12:
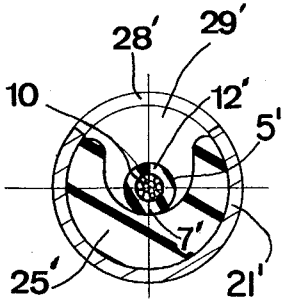
Figure 8:
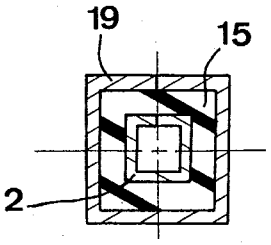

Sleeve 15 is itself lodged in the interior of tubular body 19, of substantially square section, of a peripheral conductor element 18, surrounding the greater part of the central element 1, especially its contact head 3. Tubular body 19 constitutes the part of the peripheral element 18 capable of coming in contact with a conductor element of complementary form (not shown), when a connector plug, equipped with this terminal, is connected to the corresponding base, equipped with such an element of complementary form, the tubular body 19 also being able to be shaped both as a female contact element, as represented in the figures, and as a male element. The tubular body 19, a part of which, cut and folded outward, embodies an elastic retention tab 20, designed to prevent the withdrawal of the terminal from the lodging provided in the connector plug to receive it, is united, at its end facing the tail 4 of the central element 1, with an intermediate portion 21, likewise of U-shaped section, shaped as an external radial swelling, and attached to a tail, constituted in the form of a portion with a U-shaped section 22, whose base 23 is wider than the base 8 of U-shaped portion 6, and which is disposed in the prolongation, and to the rear of the U-shaped portions 5 and 6, relative to the tubular bodies 2 and 19, the three U-shaped portions 5, 6 and 22 thus aligned, being open on the same size. Insulating sleeve 15 is prolonged, on the side of the U-shaped portions 5 and 6, by a tongue 24, likewise of insulating material, lodged between the two U-shaped portions 5 and 6 of the central element 1, and the intermediate portion 21 of the peripheral element 18, and exhibiting an extra thickness 25 between the two internal and external radial swellings embodied by the base 7 of U-shaped portion 5 and the intermediate portion 21, this extra thickness 25, which envelopes not only the base 7 but also the flanks 12 of the U-shaped portion 5, as seen in FIGS. 3 and 9, serving as a stop preventing any relative displacement of the two conductor elements 1 and 18 which are electrically insulated from one another by sleeve 15 and tongue 24 of insulating material.

As appears more particularly in FIGS. 8 to 11, the armor braid 26, suitably stripped, of the coaxial cable 9, is thus received between the flanks 27 of the U-shaped portion 22, when core 10 and sheath 11 are respectively disposed between the flanks 12 and 13 of the U-shaped portions 5 and 6, so that, by means of a single tool, and in a single operation, it is possible to crimp the coaxial cable 9 on the terminal by folding back the flanks 12, 13 and 27 of the U-shaped portions 5, 6 and 22 respectively on the core 10, the insulating sheath 11 and armor braid 26 of the cable 9. This simultaneously establishes an electric contact between the core 10 and the central conductor element 1, and an electric contact between the armor braid 26 and the peripheral conductor element 18 by a single crimping operation which is easy to operate automatically.

Furthermore, the intermediate portion 21, likewise of U-shaped section, can have prolonged lateral flanks 28 of a height such that they may be folded back one against the other, prolonging the tubular form of body 19 of the peripheral element 18 by a second operation of folding back following the crimping of the coaxial cable, which makes it possible to protect the internal electric contact between the core 10 and the portion 5, and defines an air pocket 29 serving as a dielectric, around the part of portions 5 and 6, crimped on cable 9, which is not surrounded by the insulating tongue 24. The intermediate portion 21, as well as the portions 5 and 6, then have a section analogous to that of bodies 2 and 19, i.e. substantially square.

A second analogous embodiment, wherein the cross-section of the various elements is round, is shown in FIGS. 6, 7, 12 and 13.

FIGS. 6 and 7 and 12 and 13 which correspond, respectively, to FIGS. 3 and 4 and 9 and 10, represent the positions occupied by the analogous parts of a terminal in which the bodies of the central element and the peripheral element, as well as the insulating sleeve, have a circular section, the bases 7′ and 8′ of portions 5′ and 6′, the tongue 24′ and its extra thickness 25′, as well as the intermediate portion 21′, being rounded correspondingly, and the lateral flanks 28′ can be folded back to reconstitute the tubular form with circular section of the body of the peripheral element.

It is clear that the elements 1′ and 18′ can be concentric.

Figure 14:
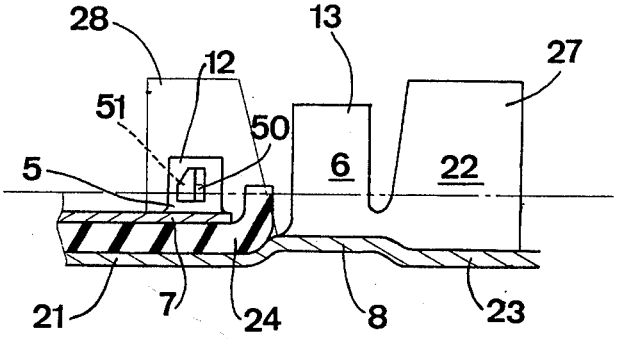
FIG. 14 represents a partial view in axial section, of another contact terminal of the first type, in which the U-shaped portion of the first element is equipped with a fork retaining the core of the coaxial cable to be connected.

In FIG. 14 is a representation of the connection end of a terminal of the first type, which is distinguished essentially from that represented in FIG. 1 by the fact that the U-shaped portion 6 designed to receive the insulating sheath 11 of the core 10 of the coaxial cable 9, is borne, not at the end of the central element 1 to the rear of the U-shaped portion 5 with base 7 that is narrowest relative to body 2, but by the peripheral element 18, between the intermediate portion 21 and the U-shaped portion 22, to which the U-shaped portion 6 is attached by its base 8, extended by the base 23 of the U-shaped portion 22. The insulating tongue 24 is thus disposed between the intermediate portion 21 and the U-shaped portion 5 of the central element. U-shaped portion 5 is equipped with an internal contact fork whose arms 50, facing one another in the U-shaped portion 5, and which have been obtained by cutting parts 51 out of the flanks 12 of U-shaped portion 5. The parts 51 are then folded back around an axis essentially perpendicular to the axis of the terminal, corresponding to the axis of the coaxial cable after connection.

The suitably stripped end of the coaxial cable to be connected, will be positioned on the terminal by a translation in a direction perpendicular to its axis, which will procure a retention of the core 10 in the interior of the U-shaped portion 5, by a nip between the arms 50 of the fork, then the procedure will be as above, in the connection by crimping, folding back the flanks 12, 13 and 27, of the U-shaped portions 5, 6 and 22, respectively on the core 10, the insulating sheath 11 and the armor braid 26 of cable 9. The flanks 28 of the intermediate portion 21 can then be folded back to reconstitute, at this level, the tubular form of the coaxial terminal.

Figure 15:
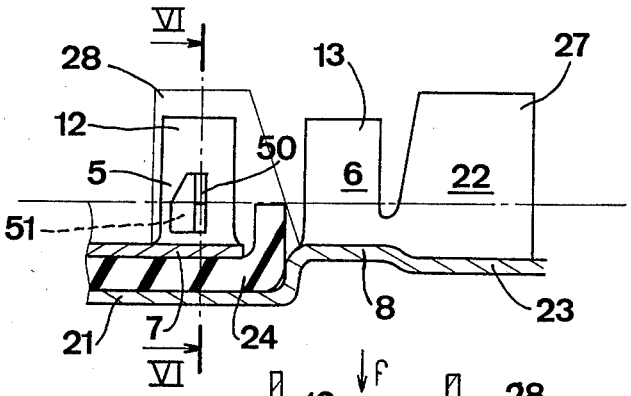
FIG. 15 represents, in analogous fashion, a variation of the embodiment of the terminal according to FIG. 5, in which the retention fork is self-stripping.
Figure 16:
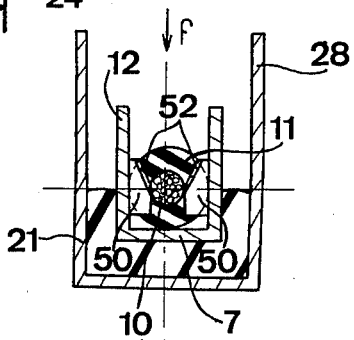
FIG. 16 represents a view in section along VI—VI, of the terminal according to FIG. 15, the end of a coaxial cable being received on the terminal.
Figure 17:
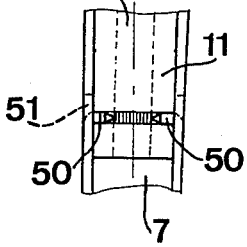
FIG. 17 is an overhead view along the arrow f in FIG. 16.

FIGS. 15 to 17, represent the corresponding parts of a variation of such a terminal, in which the fork is self-stripping, i.e. the core 10 does not have to be stripped prior to the connection operation, the arms 50 of the fork having a profile such that they cut out a portion of the insulating sheath 11, and come in contact with core 10, in the course of the insertion of the end of the cable into the entry bevel 52 in the fork, defined by the arms 50. In this embodiment, the base 8 of U-shaped portion 6 is substantially equal in width to that of the base 7 of the U-shaped portion 5, while in the preceding embodiment this base 8 was wider than that of base 7.

The present invention responds to the general problem of the connection which can be made automatically on coaxial cables, whether it is a matter of prolonging a link by connecting different coaxial cables end to end, which will advantageously be done by means of terminals according to the first type, or a matter of connecting equipment, in particular, printed-circuit cards, to the ends of a coaxial cable, which cannot be done by a coaxial linkage but by two simple linkages, and which will advantageously be obtained by means of terminals according to the second type.

It is clearly understood that these forms of embodiment have been presented only by way of particular examples and do not constitute a limitation of the invention. But the forms of the sections of the various elements constituting the contact terminals correspond to the types of lodging most frequently used on the various elements of electric connectors which it is possible to equip by means of these terminals.

I claim:

1. A contact terminal to form an electrical conection with a coaxial cable, said coaxial cable including a conducting core, a core insulating layer surrounding said conducting core, and a conducting shield surrounding said core insulating layer, said contact terminal comprising:

a first internal contact member including a first open U-shaped portion having a first part with a base shaped as an internal radial swelling and a second part with a base having a dimension different from the dimension of the base of said first part;

a second external contact member having a second open U-shaped portion;

said second U-shaped portion being disposed behind said first U-shaped portion with said open U-shaped portions being toward the same side; and, insulating sleeve means disposed between said first and said second members for securing thereof together and preventing any relative displacement thereof, said insulating sleeve means comprising three coaxial portions, one of said coaxial portions being an extra-thickness portion between said said two other coaxial portions and thicker than said two other coaxial portions and assuming substantially the exact shape of said internal radial swelling of said first internal contact member, said one of said coaxial portions coinciding with the base of said first part and one of the other of said two coaxial portions coinciding with the base of said second part.

2. The contact terminal of claim 1 wherein said second U-shaped member has a base wider than said first U-shaped member.

3. A contact terminal according to claim 1, in which at least one said U-shaped portions is provided with an internal contact fork.

4. A contact terminal according to claim 3, in which at least one of said internal contact forks is self-stripping.

5. The contact terminal according to claim 2, further including a third U-shaped portion which is disposed between the two other U-shaped portions in line therewith, and open at the same side, the base portion of said third U-shaped portion being of a width which is less than the width of the base portion of the U-shaped portion of the second member and greater than or equal to the width of the base portion of the U-shaped portion of the first member, to permit a mechanical connection of the terminal to the core insulating layer.

6. A contact terminal according to claim 2, 3 or 4, wherein said terminal is in coaxial form, further comprising a central member an insulating sheath and a peripheral member, said central member surrounded by said peripheral member; said central member forming said first member with said first U-shaped portion forming one of the ends of a body whose other end forms a contact head, and the peripheral member forming said second member with said second U-shaped portion connected by an intermediate portion to a tubular body which encloses said insulating sheath, said insulating sheath surrounding the body of the central member and being extended by an insulating tongue portion which is housed between said second U-shaped portion of said peripheral member and said intermediate portion of said peripheral member.

7. A contact terminal according to claim 5, wherein said terminal is in coaxial form, further comprising a central member an insulating sheath and a peripheral member, said central member surrounded by said peripheral member; said central member forming said first member with said first U-shaped portion forming one of the ends of a body whose other end forms a contact head, and the peripheral member forming said second member with said second U-shaped portion connected by an intermediate portion to a tubular body which encloses said insulating sheath, said insulating sheath surrounding the body of the central member and being extended by an insulating tongue portion which is housed between said second U-shaped portion of said peripheral member and said intermediate portion of said peripheral member.

8. A contact terminal according to claim 7 wherein said third U-shaped portion is carried by the central member behind the U-shaped portion which has the narrower base portion, with respect to the body of said central member, said insulating tongue portion extending between said third U-shaped portion and said intermediate portion.

9. A contact terminal according to claim 7 wherein said third U-shaped portion is carried by the peripheral member between the U-shaped portion which has the wider base portion and said intermediate portion.

10. A contact terminal according to claim 7, 8 or 9, in which said intermediate portion comprises two side flank portions capable of being bent over and is also of U-shaped section so that, after connection of the coaxial cable, bending over of said side flank portions around the portions of the central member which is connected to the cable, provides protection for said portion.

11. The contact terminal according to claim 10, wherein the height of said side flank portions is such that they can be bent over towards each other, extending the tubular shape of the body of the peripheral member and defining an air pocket which serves as a dielectric around the part, which is not surrounded by the insulating tongue portion, of the portion of the central member which is connected to the cable.

12. A contact terminal according to claim 7 further comprising a carrier strip, said carrier strip mounting a plurality of said terminals at a given pitch, to form a continuous strip, which connection makes it possible easily to automate the formation of a crimped connection between a coaxial cable and each of the terminals, the carrier strip being sheared off when the connection is made.

13. A contact terminal as claimed in claim 1, including an external radial swelling forming part of said second external contact member for coinciding with said internal radial swelling of said first internal contact member.

* * * * *